US006079059A

United States Patent [19]

Girerd

[11] Patent Number: 6,079,059

[45] Date of Patent: Jun. 27, 2000

[54] MOVABLE COVERING DEVICE, PARTICULARLY FOR SWIMMING POOLS

[75] Inventor: Marc Girerd, Villemoutiers, France

[73] Assignee: Toutenkamion, Bellegarde, France

[21] Appl. No.: 09/077,579

[22] PCT Filed: Nov. 29, 1996

[86] PCT No.: PCT/FR96/01891

§ 371 Date: Jun. 1, 1998

§ 102(e) Date: Jun. 1, 1998

[87] PCT Pub. No.: WO97/20114

PCT Pub. Date: Jun. 5, 1997

[30] Foreign Application Priority Data

Nov. 30, 1995 [FR] France ..... 95 14183

[51] Int. Cl.[7] ..... E04H 4/00

[52] U.S. Cl. ..... 4/498; 4/494

[58] Field of Search ..... 4/494, 498, 503; 52/66, 69

[56] References Cited

U.S. PATENT DOCUMENTS

| | | | |
|---|---|---|---|
| 3,209,373 | 10/1965 | Meredith et al. | 4/172 |
| 3,832,741 | 9/1974 | Ward | 4/172.12 |
| 3,854,149 | 12/1974 | Mischke | 4/172.11 |
| 4,163,295 | 8/1979 | Schutz | 4/172.14 |

FOREIGN PATENT DOCUMENTS

| | | |
|---|---|---|
| 2336939 | 2/1974 | Germany . |
| 2733338 | 2/1978 | Germany . |
| 7802579 | 5/1978 | Germany . |

*Primary Examiner*—Steven O. Douglas
*Assistant Examiner*—Huyen Le
*Attorney, Agent, or Firm*—Greer, Burns, & Crain, Ltd.

[57] ABSTRACT

A roof movable between a raised position in which it forms a shelter over a terrace and a lowered position in which it forms a cover over a swimming pool. The roof is mounted on pivotable pillars via hinges. One edge of the roof is supported in the raised position by a winch and cable device for moving the roof assembly between the two positions.

45 Claims, 3 Drawing Sheets

MOVABLE COVERING DEVICE, PARTICULARLY FOR SWIMMING POOLS

BACKGROUND OF THE INVENTION

The present invention relates to a moveable covering device, particularly for swimming pools, game areas or the like, and more particularly for average-sized swimming pools such as private swimming pools.

Moveable covering devices for swimming pools are known from U.S. Pat. Nos. 3,854,149 and 3,209,373. The mobility consists in causing the cover itself to move from a position in which it forms a cover over the swimming pool to a position in which the cover forms a shelter from the sun or the rain above a terrace or the like formed in the proximity of the pool.

The structure described in U.S. Pat. No. 3,854,149 is of the pivoting type. The cover is formed of articulated panels. To put the device into the shelter position, it is necessary to install support columns. According to U.S. Pat. No. 3,209,373, the cover itself is supported by pivoting arms. In the shelter position, the structure is unstable, particularly in the presence of a wind.

The Soviet Patent No. 318,237 describes a movable covering device for stadiums. Each cover panel is supported by two swinging arms forming a deformable parallelogram. Such a device is very expensive to produce if good results are required in terms of operational quality, stability, safety and reliability.

The object of the invention is therefore to propose a moveable covering device which is simple, stable and reliable.

SUMMARY OF THE INVENTION

According to the invention, the moveable covering device for swimming pools, game areas or the like, comprising a roof which is moveable between a lowered position in which it covers, in a substantially sealed manner, a first region which may be a swimming pool, game area or similar, and a raised position in which the roof covers, at a certain height, a second region which is offset with respect to the first region, the roof having a first edge on the side nearest the first region and a second edge opposite to the first edge, the device furthermore comprising a structure having an articulation with the ground and an articulation with the roof at a distance from the second edge, and having, starting from the articulation with the ground, a general orientation going from the second region towards the first region when the roof is in the lowered position, is characterised by support means for supporting the roof in the vicinity of the second edge when the roof is in the raised position, the roof being spaced apart from the support means when it is in the lowered position.

The support means can be and preferably are arranged permanently at a certain distance from the first region such as a swimming pool. They are not used when the roof is in the lowered position. In the raised position, the roof is stabilized by the support means. This makes it possible to provide for the roof to be a relatively heavy and/or voluminous assembly, capable of covering a swimming pool or the like having a relative large size, and having, for example, the appearance of a conventional roof. A relatively heavy structure is capable, because of its own weight, of closing in a substantially sealed manner the periphery of the first region when the roof is in the lowered position. It is therefore possible to protect the first region from the intrusion of small animals or insects. If the roof is opaque, the development of algae and other harmful phenomena due to light and in particular due to photosynthesis is prevented.

Preferably, the device comprises means of hoisting the second edge of the roof to its position defined by the support means. It is advantageous for the hoisting means to comprise a winch or the like coupled to a pulling cable extending between the roof and a position close to the support means, in such a way that by pulling on the cable the roof, which is initially in the lowered position, is pulled along a path leading the second edge towards the support means, with a spontaneous pivoting of the pivoting structure also causing the raising of the first edge.

It therefore essentially suffices to operate the hoisting means in order to cause the roof to move from its lowered position to its raised position.

Other features and advantages of the invention will furthermore emerge from the following description relating to a non-limitative example.

DETAILED DESCRIPTION

Figure 1:
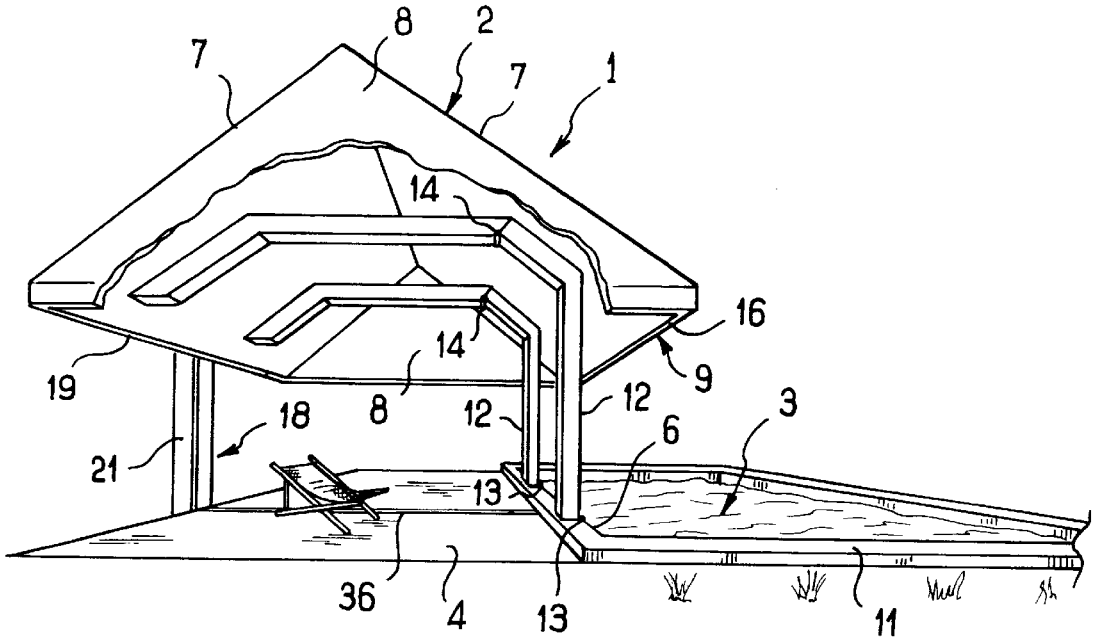
FIGS. 1 and 2, are diagrammatic views in perspective showing the device according to the invention with the roof in the raised position and in the lowered position respectively.

In the example shown in FIGS. 1 to 5, the movable covering device 1 comprises a roof 2 which the device allows to be moved between a lowered position (FIGS. 2 and 3) in which the roof 2 forms a closure over a first region which in this example is a rectangular swimming pool 3, and a raised position (FIGS. 1 and 5) in which the roof 2 forms a shelter from the sun or from bad weather above a second region such as a terrace 4 adjacent to a longitudinal edge 6 of the swimming pool 3.

In the example shown, the roof 2 has the shape of a conventional roof with two oblique panels 7, closed at each end by a vertical triangular wall 8.

The roof is made from opaque material and comprises a rectangular lower peripheral edge 9 designed and sized to bear in a substantially sealed manner onto the rectangular periphery 11 of the swimming pool 3. The periphery 11 includes the previously mentioned edge 6. If necessary, a sealing gasket can be fitted to the edge 9 of the roof to bear against the periphery 11 of the swimming pool 3 when the roof 2 is in the lowered position. It is also conceivable that the lower edge 9 be sufficiently large to surround the periphery 11 of the swimming pool 3 and bear for example on a concrete, paved or tiled surround formed around the swimming pool 3.

It is preferred, as shown in the illustrated example, that the raised position and the lowered position of the roof 2 are parallel with each other, but it is also conceivable, for example in the case of a roof with a single roof panel, that the latter be horizontal in the lowered position and inclined in the raised position.

The device comprises an articulated structure formed in this example by two parallel pivoting pillars 12 comprising a first articulation 13 with the edge 6 of the swimming pool 3 and a second articulation 14 with the roof 2. The articulations 13 and 14 have axes parallel with the edge 6 of the swimming pool. With respect to a vertical plane P (FIG. 3) parallel with the axes of the articulations 13 and 14 and passing through the centre of gravity G of the roof 2, the axis of articulation 14 is located so as to be offset towards a first edge 16 of the roof 2. The first edge 16 of the roof 2 is the one which moves over the swimming pool 3 when the roof 2 moves from one to the other of its raised and lowered positions. The result of the above is that the weight of the roof 2 tends to cause the latter to pivot towards the terrace 4 about the articulations 14.

Figure 3:
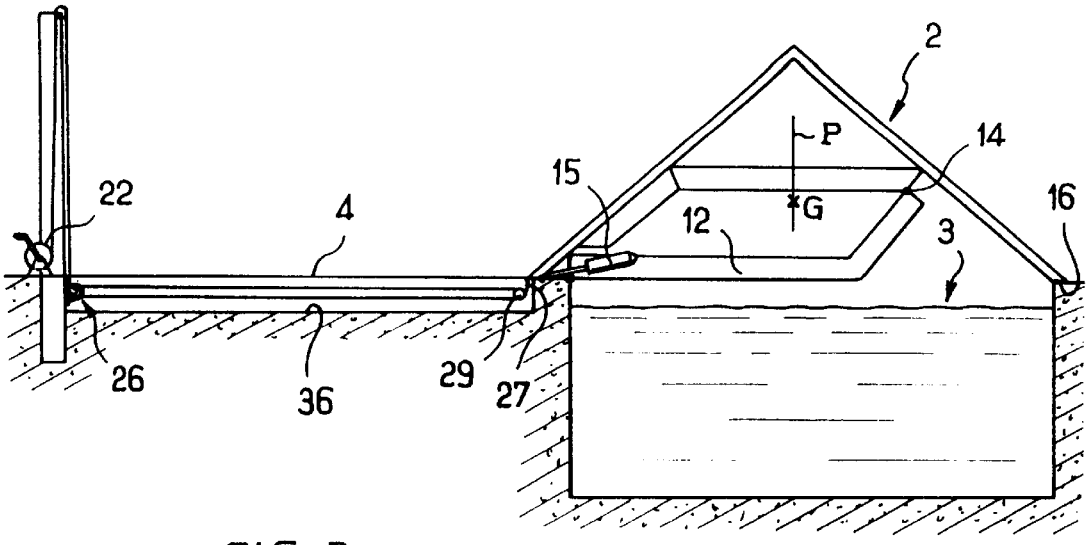
FIGS. 3, 4, and 5 are diagrammatic views in cross-section showing the device of FIGS. 1 and 2 in the lowered position, in the intermediate position during an operation, and in the raised position respectively.
Figure 5:
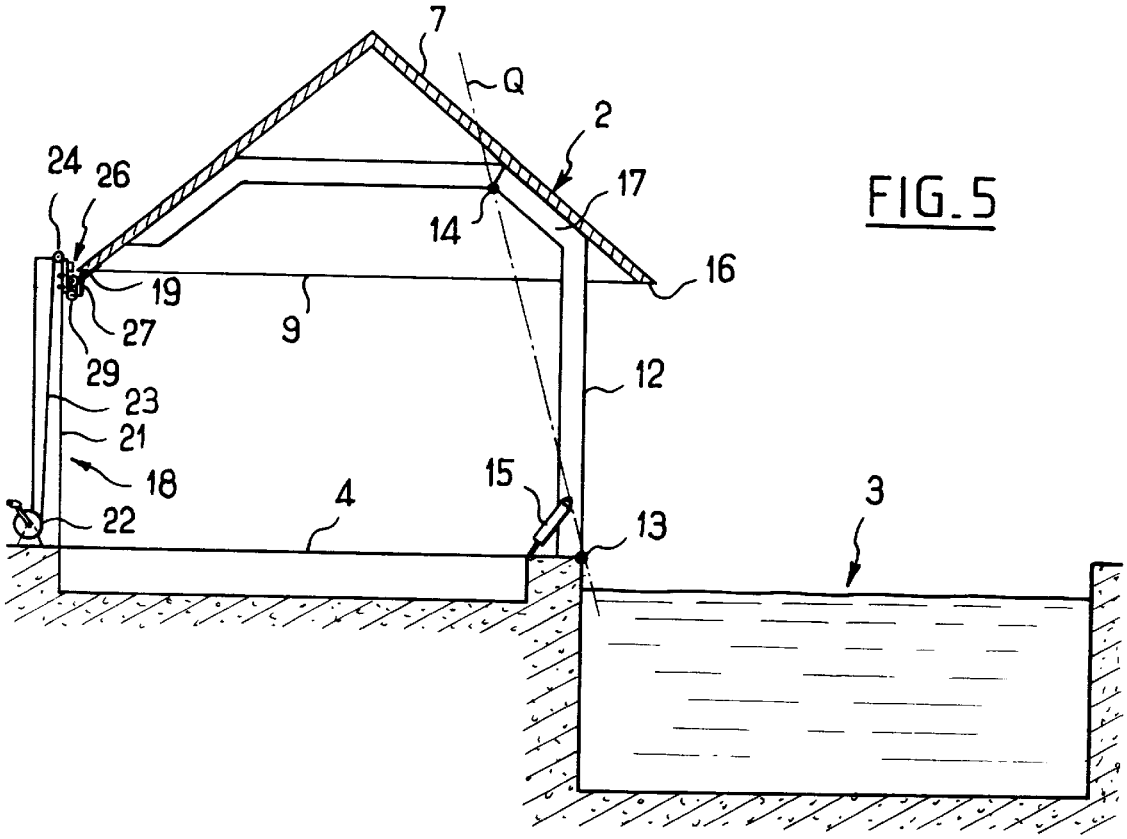

When the roof 2 moves from its lowered position to the raised position, the pillars 12 move from a lying position over the swimming pool 3, shown in FIG. 3, to an erected position shown in FIG. 5, in which the pillars 12 support, more particularly, the region of the first edge 16 of the roof 2.

Resilient means or springs 15, produced for example in the form of gas jacks, are fitted between the pillars 12 and the ground, and bias the pillars 12 towards the lying position.

In the example shown, the plane Q (FIG. 5) passing through the axes of the articulations 13 and 14 is inclined towards the terrace 4 when the roof 2 is in the raised position. By means of this arrangement, the roof 2 can, in the lowered position, cover a swimming pool having a width of e.g. 5 meters without the roof 2 being positioned at an excessive height in the raised position. It can in fact be seen in FIG. 3 that due to the inclination of the plane Q the pillars 12 do not need to extend over the whole width of the swimming pool 3 when the roof 2 is in the lowered position. Furthermore, in the example shown, the inclined disposition of the plane Q is made even more beneficial by the inclination of the roof panel facing the swimming pool 3, because the inclination of the plane Q allows the axis of articulation 14 to be placed higher. The distance between the axes 13 and 14 is thus increased, for a given distance between the peripheral lower edge 9 of the roof 2 and the terrace 4, when the roof is in the raised position.

It would have been possible to produce the inclination of the plane Q with straight pillars 12 disposed with an inclination when the roof 2 is in the raised position. In the example shown, it has been preferred to give the pivoting pillars 12 a bent configuration with a substantially vertical lower section and an upper section 17 inclined towards the second region 4 in a way which corresponds with the slope of the panel 7 of the roof 2 when the roof 2 is in the raised position. Thus, the roof 2 in the raised position butts against the upper section 17 of the pillars 12. This reinforces the stability. Furthermore, pillars 12 whose visible lower section is vertical are in most cases preferred from the aesthetic point of view.

The device according to the invention furthermore comprises means 18 of supporting the roof 2, when it is in the raised position, in the region of its second edge 19, opposite to the first edge 16. The second edge 19 is the one which moves over the terrace 4 when the roof 2 moves from one to the other of its raised and lowered positions. The means 18 comprise a stationary mast 21 which is secured to the ground in a position adjacent to the edge of the second region 4 (terrace) which is remote from the first region (swimming pool) 3. As shown in FIGS. 1 and 5, the roof 2 is supported by the mast 21 when it is in the raised position in the region of its second edge 19. When the roof 2 is in the lowered position, the whole of the roof, and in particular the second edge 19, are spaced apart from the mast 21.

Figure 2:
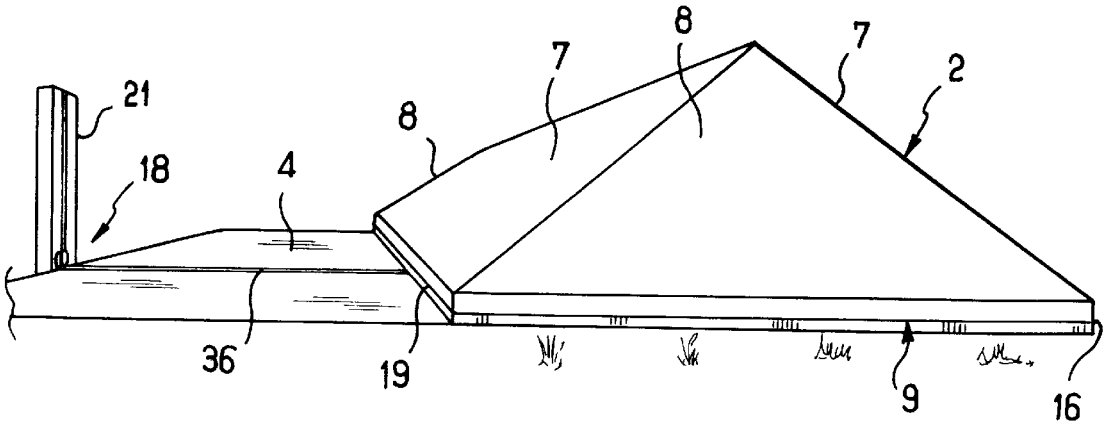

The movable covering device furthermore comprises means for pulling the edge 19 towards the mast 21 and for hoisting the second edge 19 substantially to the top of the mast 21 when it is necessary to raise the roof from the lowered position of FIGS. 2 and 3 to the raised position of FIGS. 1 and 5.

Figure 6:
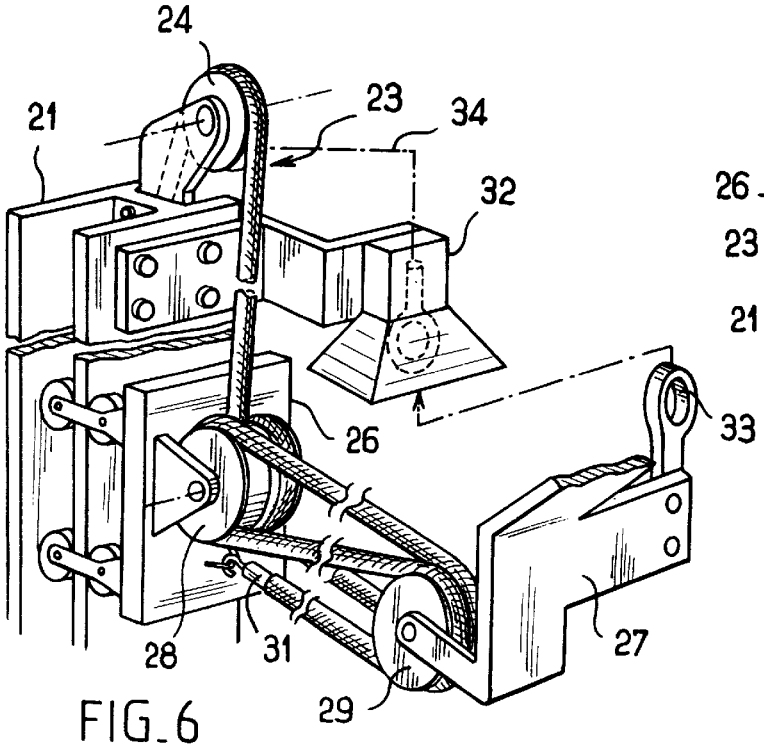
FIG. 6 is a perspective view, with tear-aways, of the support means.

The hoisting means comprise a winch 22 (FIGS. 3 to 5) able to be operated manually or by a motor, the manual method being preferred because of its reliability and its simplicity. On the winch 22 there is wound one of the ends of a cable 23 which extends as far as the region of the edge 19 which must be brought closest to the mast 21 when the roof is in the raised position. Between the winch 22 and the edge 19 of the roof 2, the cable 23 passes over a return pulley 24 at the top of the mast 21 and through a carriage 26 mounted such that it moves freely along the mast 21 which is shaped as a rail for this carriage (see FIG. 6). The carriage 26 and a bracket 27 fixed to the edge of the roof 2 carry reeving pulleys, 28 and 29 respectively, by means of which the cable 23 makes several forward and return journeys between the carriage 26 and the bracket 27. The end 31 of the cable which is remote from the winch 22 is coupled, in the example shown, to the carriage 26.

The top of the mast 21 furthermore carries an automatic coupling device 32 of the type attached to the rear of trucks, and the bracket 27 carries a coupling ring 33 compatible with the automatic coupling device 32. An unlocking control 34 extends from the automatic coupling device 32 to a point which is easily accessible to an operator, for example at a height of 1.5 meters on the mast 21.

In the ground surface of the terrace 4 there is furthermore provided a groove 36 extending between the base of the mast and the edge 6 of the swimming pool 3. The groove 36 is placed in the same vertical plane as the one followed by the bracket 27 when the roof moves from the raised position to the lowered position or vice-versa.

The operation of the covering device according to the invention will now be described.

When the roof 2 is in the lowered position (FIGS. 2 and 3), the pillars 12 are in the lying position above the swimming pool 3. The carriage 26 on the one hand and the bracket 27 with its reeving pulleys 29 on the other hand are retracted inside the groove 36 in the ground surface of the terrace 4, as are the cable lengths forming the reeving between the carriage 26 and the bracket 27.

Figure 4:
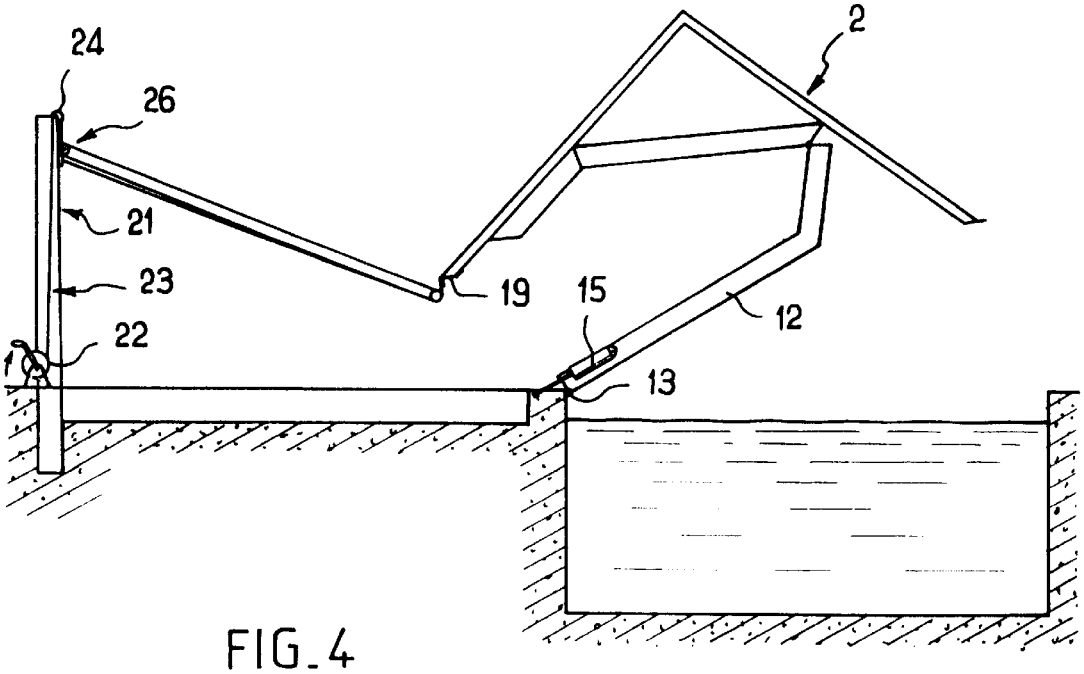

In order to make the roof 2 move into the raised position, it suffices to operate the winch 22 in the sense of pulling on the cable 23. The second edge 19 of the roof 2 is thus pulled towards the mast 21 and this forces the pillars 12 to pivot upwards about their articulations 13 with the ground as shown in FIG. 4. This compresses the springs 15. During the raising, the carriage 26 itself assumes, at all times, a position in height along the mast 21 such that it is in equilibrium with respect to the various forces or vertical components of forces acting upon it.

Figure 7:
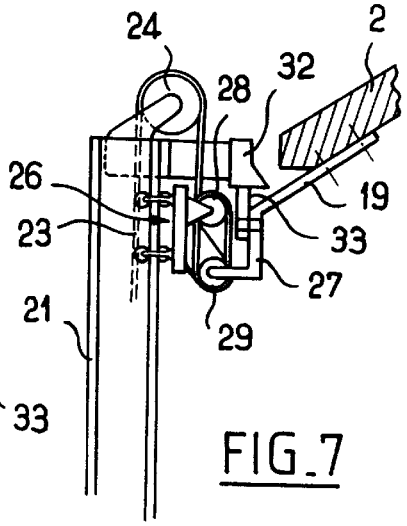
FIG. 7 is a side elevation view of the support means when the roof is in the raised position.

When the cable 23 has been wound sufficiently for the length of the cable lengths between the reeving pulleys 28 and 29 to be minimal, the pulleys 29 carried by the roof 2 are substantially located under the pulleys 28 of the carriage 26, which is substantially located at the top of the mast 21. The end of the movement causes the engagement of the ring 33 in the automatic coupling 32 to end up in the situation shown in FIG. 7.

In the raised position, it is the tension of the cable 23 which principally supports the second edge 19 of the roof 2 at the desired height. This function of locking the cable 23 is provided by the winch 22 which is normally designed to oppose any movement of unwinding the cable 23 under the effect of the tension in the cable 23. The coupling 32, 33 has a safety function for cases of breakage of the cable 23. The coupling 32, 33 furthermore has a function of horizontal immobilization of the edge 19 with respect to the mast 21.

In order to make the roof 2 move into the lowered position, the release of the coupling 32,33 is provoked by means of the control 34 and then the winch 22 is operated in the unwinding direction. As the cable is unwound, the edge 19 of the roof loses height and at the same time the springs 15 push the pivoting pillars 12 towards their lying position. The reverse movement of the one described previously occurs until the lowered position as shown in FIGS. 2 and 3 is achieved.

The invention is not of course limited to the example described and illustrated.

There could be at least two masts such as 21 and/or two cables able to be actuated by the same winch or by two different winches able to be synchronized.

It is also possible to replace the mast 21 by a structure fixed on an existing structure such as a facade or similar.

In particular, in the case where there are at least two masts, the number of pivoting pillars could be reduced to just one. If there are several pillars, these may be connected by cross-pieces having, in particular, the purpose of synchronizing them better in their rotation about the articulation 13 with the ground.

The carriage, such as 26, is not indispensable and it would be possible to connect the cable directly from the top of the mast or similar to the roof such as 2. There would then be the disadvantage that the cable is not sunk when the roof is in the lowered position.

It is not essential to lock the roof 2 in the raised position. It is also possible to lock it with means other than those with automatic coupling described and illustrated. For example, the edge 19 of the roof could, by sliding along the mast at the end of the movement towards the raised position, pass over an asymmetrical projection from which it could not subsequently disengage itself as long as the winch is not operated in the unwinding sense. When such a movement of the winch occurs, the springs such as 15, pushing the pillars 12 towards the lying position, drive the roof 2 away from the mast 21 and thus disengage the edge 19 from the projection provided along the mast.

Another means could consist in that the projection can be retracted by means of a control accessible at the base of the mast for releasing the edge 19 of the roof when the operator wishes to carry out a manoeuvre of returning the roof 2 to the lowered position.

In the case in which there is only one pivoting pillar, its articulation with the roof can be of the ball joint type to allow adjustment of the inclination of the roof, by means of two winches controlled independently from one another, each associated with one of the two fixed masts. Between each fixed mast and the roof, each cable extends preferably in a vertical plane passing through the centre of the ball joint. It is possible to increase the stability of the assembly by means of two jacks mounted between the pivoting pillar and the roof in an oblique position on each side of the pivoting pillar.

I claim:

1. A movable covering device comprising a roof which is movable between a lowered position in which the roof covers a first region in a substantially sealed manner, and a raised position in which the roof covers, at a certain height, a second region which is offset with respect to the first region, the roof having a first edge on the side nearest the first region and a second edge opposite to the first edge, a pivoting structure having an articulation with the ground and an articulation with the roof at a distance from the second edge, and having, starting from the articulation with the ground, a general orientation going from the second region towards the first region when the roof is in the lowered position, support means for supporting the roof in the vicinity of the second edge when the roof is in the raised position, the roof being spaced apart from the support means when it is in the lowered position, and means for hoisting the second edge of the roof to its position defined by the support means.

2. The device according to claim 1, wherein said hoisting means comprise a winch coupled to a pulling cable extending between the roof and a position close to the support means, in such a way that by pulling on the cable, the roof, which is initially in the lowered position, is pulled along a path leading the second edge towards the support means, with a spontaneous pivoting of the pivoting structure also causing the raising of the first edge.

3. The device according to claim 2, wherein between said close position and the roof, the cable passes through a carriage guided along a substantially vertical path, which is substantially vertically aligned beneath the close position.

4. The device according to claim 3, wherein said carriage is freely mobile along the path.

5. The device according to claim 1, wherein said pivoting structure is articulated with the ground in the vicinity of the edge of the first region which is adjacent to the second region.

6. The device according to claim 1, wherein said pivoting structure is articulated with the roof on the same side as the first edge of the roof with respect to a vertical plane passing through the center of gravity (G) of the roof.

7. The device according to claim 1, wherein a resilient means biases the pivoting structure towards its angular orientation corresponding to the lowered position of the roof.

8. The device according to claim 1, wherein a plane passing through the articulations of the pivoting structure with the ground and with the roof respectively, is inclined towards the second region when the roof is in the raised position.

9. The device according to claim 1, wherein the pivoting structure is bent in such a way as to exhibit, when the roof is in the raised position, a substantially vertical section, starting from the articulation with the ground, followed by a section inclined towards the second region.

10. The device according to claim 9, wherein the roof has a slope and when the roof is in the raised position, the section inclined towards the second region follows the slope of the roof.

11. The device according to claim 1, wherein in the lowered position the roof bears in a substantially sealed manner on the ground around the first region.

12. A movable covering device, comprising a roof which is movable between a lowered position in which the roof covers a first region in a substantially sealed manner, and a raised position in which the roof covers, at a certain height, a second region which is offset with respect to the first region, the roof having a first edge on the side nearest the first region and a second edge opposite to the first edge, a pivoting structure having an articulation with the ground and an articulation with the roof at a distance from the second edge, and having, starting from the articulation with the ground, a general orientation going from the second region towards the first region when the roof is in the lowered position, said pivoting structure being articulated with the roof on the same side as the first edge of the roof with respect to a vertical plane passing through the center of gravity (G) of the roof, and support means for supporting the roof in the vicinity of the second edge when the roof is in the raised position, the roof being spaced apart from the support means when it is in the lowered position.

13. The device according to claim 12, wherein means are provided for hoisting the second edge of the roof to its position defined by the support means, said hoisting means comprising a winch coupled to a pulling cable extending between the roof and a position close to the support means, in such a way that by pulling on the cable, the roof, which is initially in the lowered position, is pulled along a path leading the second edge towards the support means, with a spontaneous pivoting of the pivoting structure also causing the raising of the first edge.

14. The device according to claim 13, wherein between said close position and the roof, the cable passes through a carriage guided along a substantially vertical path, which is substantially vertically aligned beneath the close position.

15. The device according to claim 14, wherein said carriage is freely mobile along the path.

16. The device according to claim 12, wherein said pivoting structure is articulated with the ground in the vicinity of the edge of the first region which is adjacent to the second region.

17. The device according to claim 12, wherein a resilient means biases the pivoting structure towards its angular orientation corresponding to the lowered position of the roof.

18. The device according to claim 12, wherein a plane passing through the articulations of the pivoting structure with the ground and with the roof respectively, is inclined towards the second region when the roof is in the raised position.

19. The device according to claim 12, wherein the pivoting structure is bent in such a way as to exhibit, when the roof is in the raised position, a substantially vertical section, starting from the articulation with the ground, followed by a section inclined towards the second region.

20. The device according to claim 19, wherein the roof has a slope and when the roof is in the raised position, the section inclined towards the second region follows the slope of the roof.

21. The device according to claim 12, wherein in the lowered position the roof bears in a substantially sealed manner on the ground around the first region.

22. A movable covering device, comprising:

a roof which is movable between a lowered position in which the roof covers a first region in a substantially sealed manner, and a raised position in which the roof covers, at a certain height, a second region which is offset with respect to the first region, the roof having a first edge on the side nearest the first region and a second edge opposite to the first edge, a pivoting structure having an articulation with the ground and an articulation with the roof at a distance from the second edge, and having, starting from the articulation with the ground, a general orientation going from the second region towards the first region when the roof is in the lowered position, support means for supporting the roof in the vicinity of the second edge when the roof is in the raised position, the roof being spaced apart from the support means when it is in the lowered position, and resilient means biasing the pivoting structure towards its angular orientation corresponding to the lowered position of the roof.

23. The device according to claim 22, wherein means are provided for hoisting the second edge of the roof to its position defined by the support means, said hoisting means comprising a winch coupled to a pulling cable extending between the roof and a position close to the support means, in such a way that by pulling on the cable, the roof, which is initially in the lowered position, is pulled along a path leading the second edge towards the support means, with a spontaneous pivoting of the pivoting structure also causing the raising of the first edge.

24. The device according to claim 23, wherein between said close position and the roof, the cable passes through a carriage guided along a substantially vertical path, which is substantially vertically aligned beneath the close position.

25. The device according to claim 24, wherein said carriage is freely mobile along the path.

26. The device according to claim 22, wherein said pivoting structure is articulated with the ground in the vicinity of the edge of the first region which is adjacent to the second region.

27. The device according to claim 22, wherein a plane passing through the articulations of the pivoting structure with the ground and with the roof respectively, is inclined towards the second region when the roof is in the raised position.

28. The device according to claim 22, wherein the pivoting structure is bent in such a way as to exhibit, when the roof is in the raised position, a substantially vertical section, starting from the articulation with the ground, followed by a section inclined towards the second region.

29. The device according to claim 28, wherein the roof has a slope and when the roof is in the raised position, the section inclined towards the second region follows the slope of the roof.

30. The device according to claim 22, wherein in the lowered position the roof bears in a substantially sealed manner on the ground around the first region.

31. A movable covering device, the device comprising a roof which is movable between a lowered position in which the roof covers a first region in a substantially sealed manner, and a raised position in which the roof covers, at a certain height, a second region which is offset with respect to the first region, the roof having a first edge on the side nearest the first region and a second edge opposite to the first edge, a pivoting structure having an articulation with the ground and an articulation with the roof at a distance from the second edge, and having, starting from the articulation with the ground, a general orientation going from the second region towards the first region when the roof is in the lowered position, wherein a plane passing through the articulations of the pivoting structure with the ground and with the roof respectively is inclined towards the second region when the roof is in the raised position, support means for supporting the roof in the vicinity of the second edge when the roof is in the raised position, the roof being spaced apart from the support means when it is in the lowered position.

32. The device according to claim 31, wherein means are provided for hoisting the second edge of the roof to its position defined by the support means, said hoisting means comprising a winch coupled to a pulling cable extending between the roof and a position close to the support means, in such a way that by pulling on the cable, the roof, which is initially in the lowered position, is pulled along a path leading the second edge towards the support means, with a spontaneous pivoting of the pivoting structure also causing the raising of the first edge.

33. The device according to claim 32, wherein between said close position and the roof, the cable passes through a carriage guided along a substantially vertical path, which is substantially vertically aligned beneath the close position.

34. The device according to claim 33, wherein said carriage is freely mobile along the path.

35. The device according to claim 31, wherein said pivoting structure is articulated with the ground in the vicinity of the edge of the first region which is adjacent to the second region.

36. The device according to claim 31, wherein the pivoting structure is bent in such a way as to exhibit, when the roof is in the raised position, a substantially vertical section, starting from the articulation with the ground, followed by a section inclined towards the second region.

37. The device according to claim 36, wherein the roof has a slope and when the roof is in the raised position, the section inclined towards the second region follows the slope of the roof.

38. The device according to claim 31, wherein in the lowered position the roof bears in a substantially sealed manner on the ground around the first region.

39. A movable covering device comprising a roof which is movable between a lowered position in which the roof covers a first region in a substantially sealed manner, and a raised position in which the roof covers, at a certain height, a second region which is offset with respect to the first region, the roof having a first edge on the side nearest the first region and a second edge opposite to the first edge, a pivoting structure having an articulation with the ground and an articulation with the roof at a distance from the second edge, and having, starting from the articulation with the ground, a general orientation going from the second region towards the first region when the roof is in the lowered position, the pivoting structure being bent in such a way as to exhibit, when the roof is in the raised position, a substantially vertical section, starting from the articulation with the ground, followed by a section inclined towards the second region, and support means for supporting the roof in the vicinity of the second edge when the roof is in the raised position, the roof being spaced apart from the support means when it is in the lowered position.

40. The device according to claim 39, wherein means are provided for hoisting the second edge of the roof to its position defined by the support means, said hoisting means comprising a winch coupled to a pulling cable extending between the roof and a position close to the support means, in such a way that by pulling on the cable, the roof, which is initially in the lowered position, is pulled along a path leading the second edge towards the support means, with a spontaneous pivoting of the pivoting structure also causing the raising of the first edge.

41. The device according to claim 40, wherein between said close position and the roof, the cable passes through a carriage guided along a substantially vertical path, which is substantially vertically aligned beneath the close position.

42. The device according to claim 41, wherein said carriage is freely mobile along the path.

43. The device according to claim 39, wherein said pivoting structure is articulated with the ground in the vicinity of the edge of the first region which is adjacent to the second region.

44. The device according to claim 39, wherein the roof has a slope and when the roof is in the raised position, the section inclined towards the second region follows the slope of the roof.

45. The device according to claim 39, wherein in the lowered position the roof bears in a substantially sealed manner on the ground around the first region.

* * * * *